US008475194B2

(12) United States Patent
Bertini et al.

(10) Patent No.: US 8,475,194 B2
(45) Date of Patent: Jul. 2, 2013

(54) RETICULATED FLASH PREVENTION PLUG

(75) Inventors: Glen J. Bertini, Tacoma, WA (US); Donald R. Songras, Kent, WA (US)

(73) Assignee: Novinium, Inc., Auburn, WA (US)

( * ) Notice: Subject to any disclaimer, the term of this patent is extended or adjusted under 35 U.S.C. 154(b) by 87 days.

(21) Appl. No.: 12/900,677

(22) Filed: Oct. 8, 2010

(65) Prior Publication Data

US 2011/0244702 A1 Oct. 6, 2011

Related U.S. Application Data

(60) Provisional application No. 61/252,587, filed on Oct. 16, 2009.

(51) Int. Cl.
*H01R 13/28* (2006.01)

(52) U.S. Cl.
USPC ..... 439/290

(58) Field of Classification Search
USPC ..... 439/290, 190, 201, 301–304, 181–187, 439/921
See application file for complete search history.

(56) References Cited

U.S. PATENT DOCUMENTS

| | | | | |
|---|---|---|---|---|
| 4,766,011 | A | 8/1988 | Vincent et al. | |
| 4,946,393 | A | 8/1990 | Borgstrom et al. | |
| 5,082,449 | A | 1/1992 | Borgstrom et al. | |
| 5,372,841 | A | 12/1994 | Kleyer et al. | |
| 6,332,785 | B1 | 12/2001 | Muench, Jr. et al. | |
| 6,338,637 | B1 * | 1/2002 | Muench et al. | 439/201 |
| 6,489,554 | B1 * | 12/2002 | Bertini et al. | 174/15.6 |
| 6,517,366 | B2 * | 2/2003 | Bertini et al. | 439/190 |
| 6,843,685 | B1 * | 1/2005 | Borgstrom et al. | 439/606 |
| 6,929,492 | B2 * | 8/2005 | Bertini et al. | 439/190 |
| 7,704,087 | B1 * | 4/2010 | Stagi et al. | 439/204 |

* cited by examiner

*Primary Examiner* — Jean F Duverne
(74) *Attorney, Agent, or Firm* — Davis Wright Tremaine LLP; George C. Rondeau, Jr.

(57) ABSTRACT

A connector for introducing fluid to an electrical cable affixed in a chamber internal to the connector, the connector comprising an injection port exposed to at least one exterior surface of the cable connector, wherein the injection port is in fluidic communication with the chamber, and a reticulated plug is positioned within an insulated segment of the injection port and sized to fill at least a portion thereof. The reticulated plug may be used in combination with various types of conventional injection connectors to allow swapping of an insulative permanent plug for an injection plug after a dielectric enhancement fluid has been introduced into the interior of a cable using the reticulated plug, wherein the cable is energized during the swapping operation.

22 Claims, 8 Drawing Sheets

RETICULATED FLASH PREVENTION PLUG

FIELD OF THE INVENTION

The present invention relates to connectors for high voltage electrical power cables and, more particularly, to connectors used to inject a dielectric enhancement fluid into the power cable's interior.

BACKGROUND OF THE INVENTION

High voltage (e.g., 5 to 35 kV) electrical power cables, which generally comprise a stranded conductor surrounded by a semi-conducting conductor shield, a polymeric insulation jacket, and an insulation shield, tend to deteriorate and lose dielectric integrity after being in service for a decade or more due to exposure to high electric fields and the effects of ambient moisture. The integrity, or dielectric strength, of the cable can be at least partially restored by injecting a dielectric enhancement fluid into the interstitial void volume associated with the stranded conductor, as is well known in the art (e.g., U.S. Pat. Nos. 4,766,011 and 5,372,841). Various specialized connectors have been designed to facilitate the injection of such a fluid into the cable's interior and some of these devices allow the injection process to be carried out while the cable is still energized. However, a problem associated with such a live injection process soon became apparent. In brief, when an injection component, such as that described in U.S. Pat. No. 4,946,393, is used to deliver the dielectric enhancement fluid, the energized conductor is exposed between the time an injection plug (cap) is withdrawn from the injection port after the fluid has been introduced and the time an insulating permanent plug is inserted in its stead to seal the injection port. During this interval it is possible that the high voltage may ionize the air, water, injection fluids, or other materials in the injection port and a flashover may occur between the conductor or the conductive insert of the component and a ground plane. Such an arc flash can damage the equipment, the component, the transformer or other equipment in the immediate area and presents a thermal and electrical danger for the operator as these plugs are being swapped. Although flashover is possible at all power cable voltages, the risk increases with increasing voltage and the risk is greatest with 35 kV systems. In fact, the risk is so great at 35 kV that such "live plug swapping" is not practiced with currently utilized technology, and the cable is de-energized before the swap. While de-energizing the cable eliminates the potential for electrical flashover, there is a cost and customer service penalty that must be borne by the circuit owner for the additional time, expense and inconvenience of this approach, as well as stress on the cable.

The above mentioned flashover problem is described in greater detail in U.S. Pat. Nos. 6,517,366 and 6,929,492, and a solution thereto is disclosed such that the whole injection process can be carried out without de-energizing the cable. These patents are directed towards a method and apparatus for creating a barrier after the injection of remediation fluid to block the conductive pathway between the conductive portion of an energized cable and the ground plane. Basically, this barrier comprises some sort of a mechanical valve that can be actuated to isolate the conductor from the exterior of the component, a breakaway tip which lodges in the injection port, or a high viscosity dielectric fluid which is introduced into the injection port of a component after injection of the dielectric enhancement fluid has been completed to temporarily block the port while the permanent plug is swapped for the injection plug. Complex mechanical valves add cost to the process and, if they reside within the outer boundary of the connector's conductive insert, they do not foreclose the possibility of a flashover even if they operate properly. Injecting a second fluid into the cap or plug adds another layer of complexity and cost. There is thus a need for a simpler and more cost-effective approach to provide safe operation during the injection of an energized cable.

SUMMARY OF THE INVENTION

In one embodiment, the present invention is directed to a connector for introducing fluid to an electrical cable affixed in a chamber internal to the connector, the connector comprising:

(i) an injection port exposed to at least one exterior surface of the cable connector, the injection port having fluidic communication with the chamber internal to the connector; and (ii) a reticulated plug positioned within an insulated segment of the injection port so as to fill at least a portion thereof.

In another embodiment, the present invention is directed to a high voltage electrical connector comprising: (a) an insulative body portion; (b) a conductive body portion external shield at least partially surrounding the insulative body portion; (c) a projection of electrically insulating material having a first end connected to the insulative body portion and a second end extending from the body portion; (d) an injection port extending through the projection and having an opening in the second end of the projection, the injection port communicating an exterior of the electrical connector with a conductive insert of an interior of the electrical connector; and (e) a reticulated plug positioned within an insulated segment of the injection port so as to fill at least a portion thereof.

In another embodiment, the present invention is directed to a method for introducing a dielectric enhancement fluid into the interior of a cable affixed in an internal chamber of a connector having an injection port in fluidic communication with the chamber, the method comprising:

(i) inserting a reticulated plug into an insulated segment of the injection port so as to fill at least a portion thereof;

(ii) installing an injection plug at the injection port;

(iii) injecting the fluid into the interior of the cable through said injection plug; and (iv) swapping said injection plug with a permanent plug to seal the injection port, wherein the cable is energized during at least step (iv)

DETAILED DESCRIPTION OF THE INVENTION

Figure 1A:
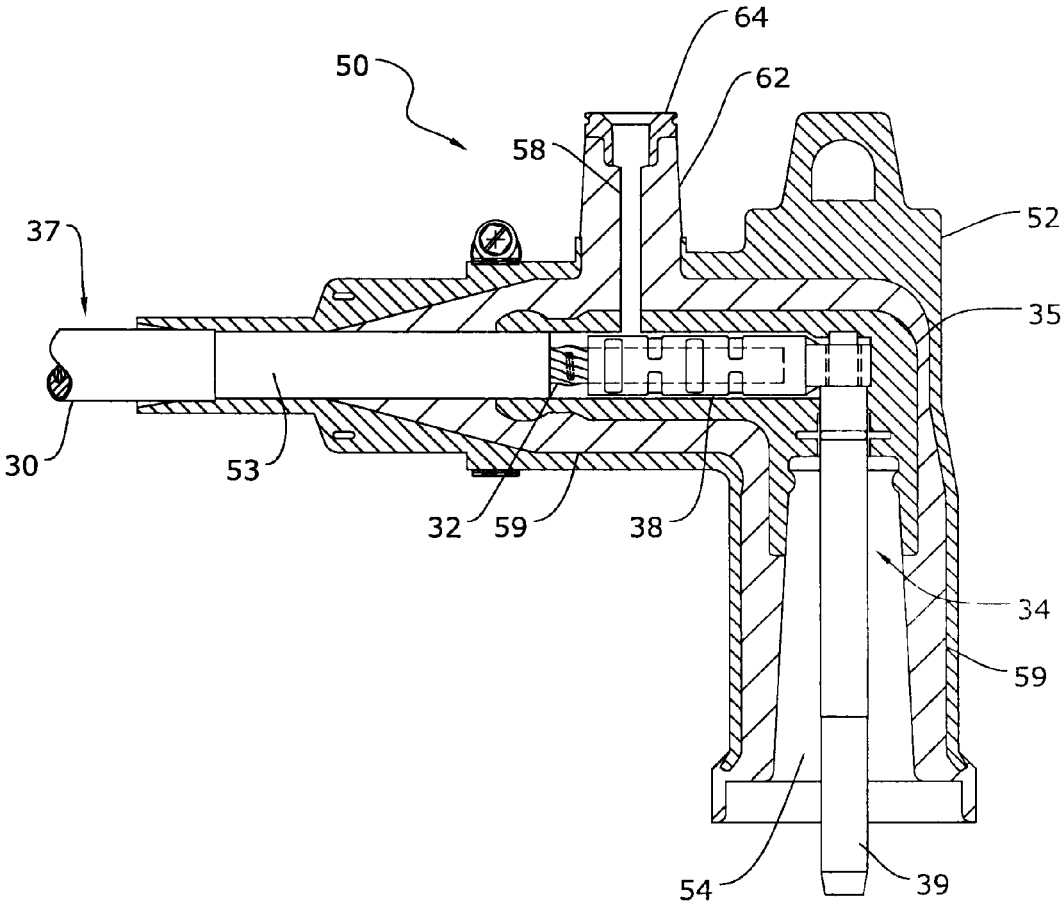
FIG. 1A is a partial cross-sectional view of a conventional injection elbow electrical connector.
Figure 1B:
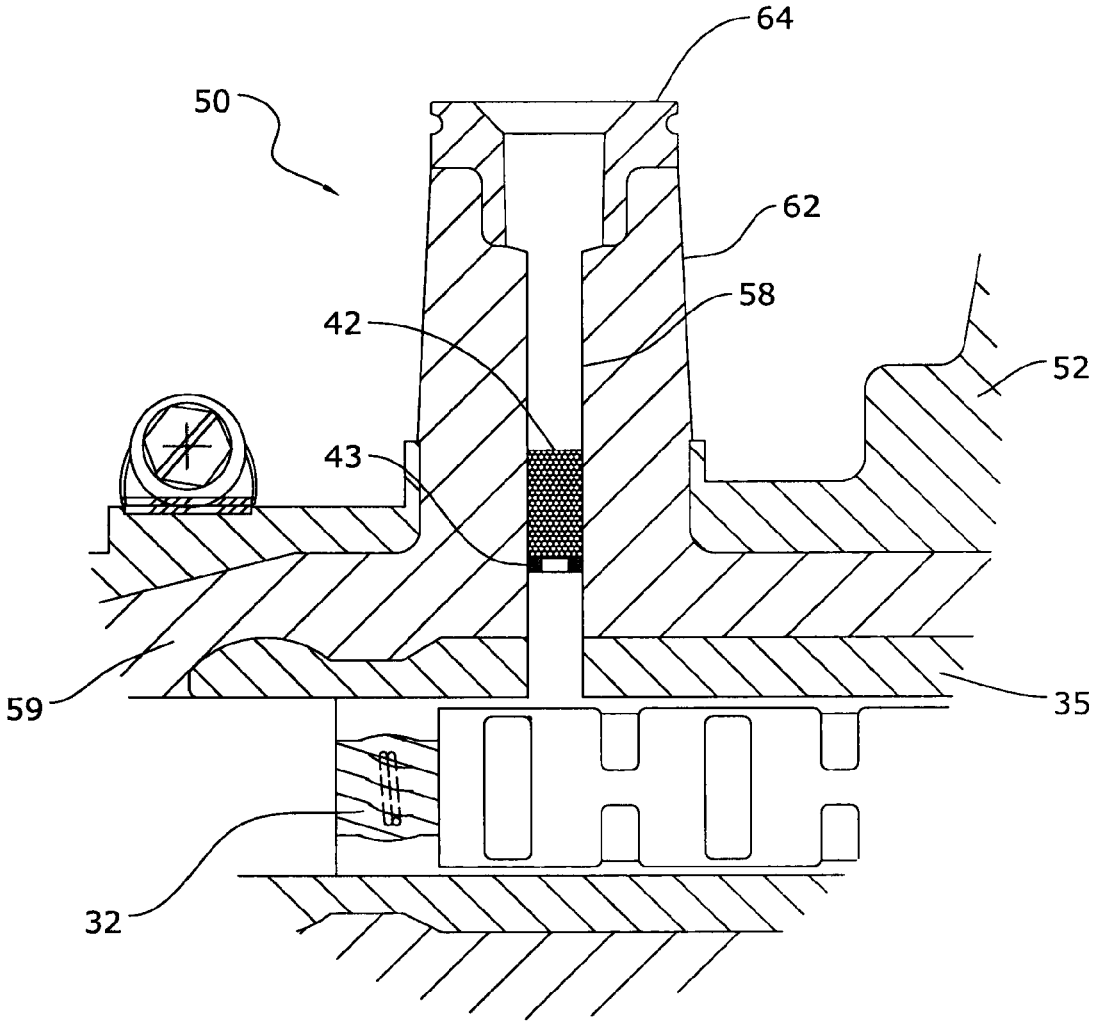
FIG. 1B is a detail of the partial cross-sectional view of the conventional injection elbow electrical connector of FIG. 1A showing a modified reticulated plug inserted within the injection port.
Figure 1C:
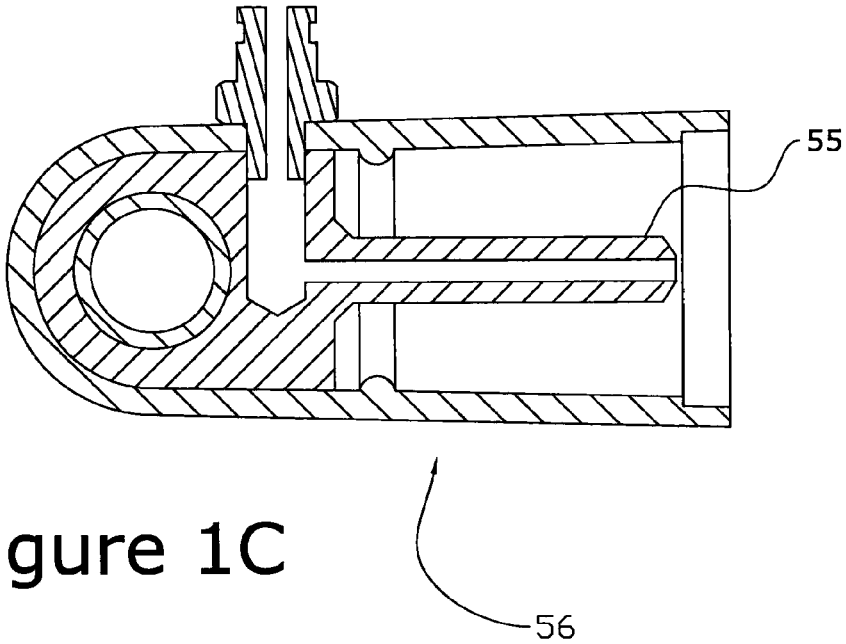
FIG. 1C is a cross-sectional view of a typical injection plug.
Figure 1D:
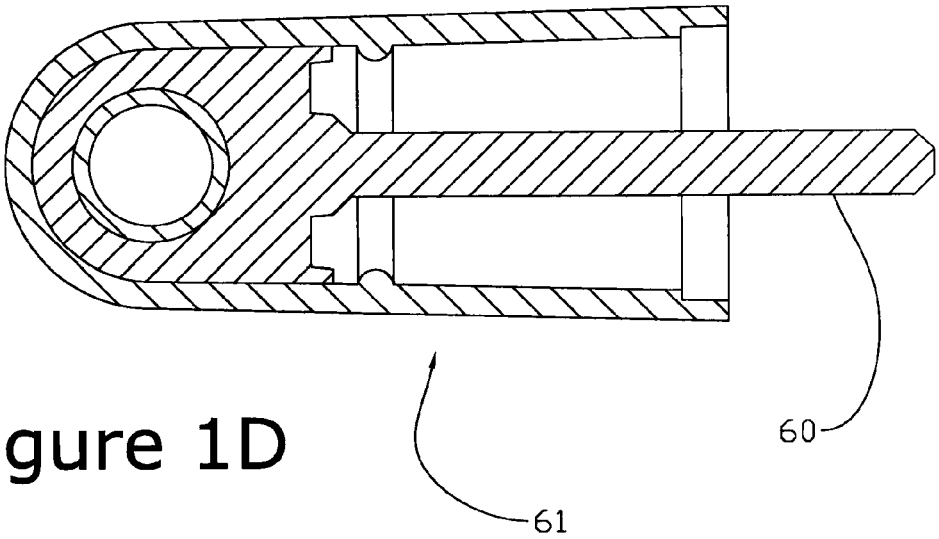
FIG. 1D is a cross-sectional view of a typical permanent plug.

The present reticulated flash prevention (RFP) plug or device, also referred to herein as a reticulated plug, may advantageously be used in combination with various types of conventional injection connectors to allow swapping of an insulative permanent plug (such as shown in FIG. 1D) for an injection plug (such as shown in FIG. 1C) after a dielectric enhancement fluid has been introduced into the interior of a cable via the injection plug, the cable being energized at least during the swapping operation. It has been found that the instant reticulated plug, positioned within the injection port of the instant connector, retains a dielectric enhancement fluid in place against the pull of gravity using capillary action of the reticulated material wetted with the fluid, thereby providing an enhanced electrically resistive path between the energized conductive interior portions of the connector and a ground plane at its exterior. This additional resistive path effectively blocks the injection port and allows sufficient time for the above described live plug swapping operation to be carried out, this procedure typically taking no more than five minutes and, under normal circumstances, less than one minute, a time of 30 seconds being common. Nevertheless, despite this blocking action, the reticulated plug allows relatively unimpeded transport of fluid into and out of the cable.

Conventional load-break elbow, dead-break elbow, tee-body or splice-type connectors are examples of connectors and components which occur at cable junctions and include injection or direct access ports, as contemplated herein. U.S. Pat. Nos. 4,946,393 and 6,332,785 exemplify the contemplated components. Such conventional injection connectors are typically limited to pressures below about 30 pounds per square inch gage (psig), but it is contemplated that the instant connectors can be employed as described herein as long as the pressure drop across the reticulated plug is not large enough to displace it during the injection step. For illustrative purposes, the use of the reticulated plug will be described in more detail in combination with a conventional load-break injection elbow connector as follows.

Injection elbow connectors are well known in the art and are used to inject a dielectric enhancement fluid, or some other fluid component, into the interior (i.e, void space associated with the stranded conductor geometry) of an electrical power cable at the above mentioned relatively low pressures. Again, both the injection and the above mentioned plug swap can be carried out while the cable is energized using appropriate hot-stick procedures. FIG. 1A shows a conventional high voltage load-break injection elbow electrical connector 50 which can be used to interconnect sources of energy, such as transformers and circuit breakers, to distribution systems and the like via a high voltage cable 37 having a stranded conductor 32 and an insulation jacket 53 and an insulation shield 30. The connector 50 typically interconnects electric sources having 5 to 35 kV of electric potential, preferably 15 to 35 kV, by a conductor coupling assembly 34 located within the connector. The conductor coupling assembly 34 is configured in a manner well known in the art such that the cable conductor strands 32 within the interior of the cable 37 are electrically coupled with a probe 39.

As shown in FIG. 1A, the conductor coupling assembly 34 includes a crimp type or compressive connector 38 in an internal chamber of the connector 50 for coupling the conductive strands 32 of the cable 37 to the probe 39. The probe 39 is threaded into one end of the compression connector 38. The probe 39 is configured to mate with a female connector device of an associated bushing, allowing easy connection and disconnection of the connector 50 to energize and de-energize the cable 37. Surrounding the compression connector 38 and the base of the probe 39 is a semi-conductive insert 35 having the same electric potential as the conductor 32 and probe 39. The insert 35 prevents corona discharges within the conductor coupling assembly 34. So configured, the connector 50, via the conductor coupling assembly 34, may be easily disconnected from the transformer or other electrical device to create a "break" in the circuit.

The connector 50 includes an insulating body portion 59 and an external conductive shield 52 molded from a conductive elastomeric material, such as a terpolymer elastomer made from ethylene-propylene diene monomers filled with carbon, and/or other conductive materials well known in the art. A preferred conductive material is carbon loaded ethylene-propylene terpolymer (EPT or EPDM). The conductive external shield 52 is preferably pre-molded in the shape of an elbow and includes a cable opening for receiving a high voltage cable 37 and a connector opening 54 for receiving an electrical connection device. Thus, the body portion conductive external shield 52 partially surrounds the body portion 59. The body portion 59 is made from an insulative material, preferably EPDM, and occupies the space between the conductor coupling assembly 34 and the conductive external shield 52. Thus, the insulative body portion 59 surrounds the semi-conductive insert 35 of the conductor coupling assembly 34 and forms a dielectric and electrically insulative barrier between the high voltage internal components and the conductive external shield 52. The insulative body portion 59 also includes openings for receiving the high voltage cable 37 and an electrical connection device such that they may be electrically connected to the conductor coupling assembly 34 within the interior of the connector 50.

It is often desirable to gain access to the interior of the connector 50, e.g., to inject a dielectric enhancement fluid or to make direct voltage test measurements. To enable this access, the connector 50 includes an injection port 58 located in a projection 62 of insulative material extending from the body portion 59. The injection port 58 is preferably a straight hole extending from the exterior of the connector 50 through the insulative projection 62 and through the insulative body 59 and the conductive insert 35 such that at least a portion of the high voltage items within the connector, preferably at least the interior of the conductor coupling assembly 34, is exposed. Although the injection port 58 is preferably a straight cylindrical hole, other shapes are possible. For instance, the injection port 58 may be inclined with respect to the conductive external shield 52, and be conical, square, triangular, oval, or other numerous configurations, so long as the interior of the connector 50 is exposed.

The reticulated plug contemplated herein is fabricated or punched from a reticulated material having good dielectric strength and resistivity. The term "reticulated" is defined as a grid-like, porous structure which blocks the passage of items larger than its characteristic pore size, while letting smaller items and fluids pass therethrough. Non-limiting examples of suitable reticulated materials include organic sponge materials, synthetic sponge materials, cotton, woven or non-woven textiles, plastic or elastomeric open-celled foams, felt, fiber glass, sintered glass, or sintered ceramic or a solid material modified to allow fluid passage. Preferably, this plug is formed from a compressible material with a density of less than 2.5 pounds per cubic foot, a 50% compression set of less than 15%, and a 25% compression force deflection less than 0.5 psi, as would be typical of a polyurethane open-celled foam that has been processed to create a reticulated structure. One such preferred polyurethane foam is available commercially from IR Specialty Foams as part number 60PPI, manufactured by Crest Foam Industries under the name of Filter-Crest® Industrial Foam Grade S-60. This is a reticulated polyester polyurethane foam having a nominal 60 pores per inch. Similar foams having more or fewer pores per inch are also suitable.

Although there is no specific limitation on the cross-sectional shape of the reticulated plug, it should fit snuggly within the injection port 58 of the connector 50 being injected and match the configuration of the port. Preferably the reticulated plug is a right circular cylinder which fits the injection port of a conventional injection connector, as described above. The outside diameter of the reticulated plug should be greater than the inside diameter of the injection port so that the former when inside the injection port is in radial compression, and thus held firmly in place, while the cable is injected. This radial compression also assures that the fluid in the reticulated plug is in full contact with the walls of the injection port to create closure of the injection port. Although the term "diameter" is used, it should be understood that this can refer to a generalized cross-sectional dimension of the reticulated plug so as to contemplate shapes other than circular, such as rectangles, triangles or other polygons. The length of the reticulated plug is not critical, but generally represents a compromise. On the one hand, there should be a sufficient open length of the injection port 58 for insertion of the stem portion 60 of a permanent plug (cap) 61 of the type shown in FIG. 1D, and described in U.S. Pat. No. 4,946,393, after the introduction of a fluid such that the reticulated plug is displaced and/or compressed by stem 60 so that it lies entirely within the conductive insert 35 of FIGS. 1A and 1B. It is, however, also contemplated that the reticulated plug can be entirely, or partially, displaced into the annular cavity between conductive insert 35 and compression connector 38, as dimensions allow. On the other hand, the reticulated plug should have an adequate length of the reticulated material (i.e., the electrically resistive path) so as to reduce the possibility of flashover. This balance, of course, depends on the operating voltage, greater reticulated plug length being preferred at higher voltages. Typically, this length is in the range of about 0.1 to about 2.0 inches, preferably about 0.25 to about 0.5 inches.

Figure 2D:
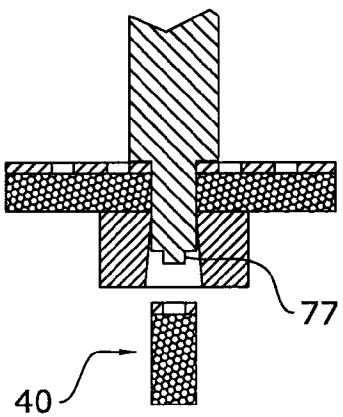
FIG. 2D is a cross-sectional view of the fiberboard/foam composite sheet prepared according to FIG. 2B after being punched to form the modified plug of FIG. 2A.
Figure 2C:
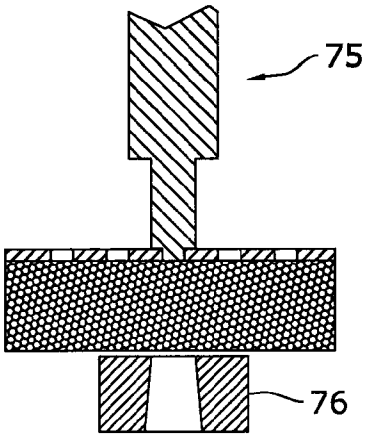
FIG. 2C is a cross-sectional view of the fiberboard/foam composite sheet prepared according to FIG. 2B positioned in a punch and die.
Figure 2B:
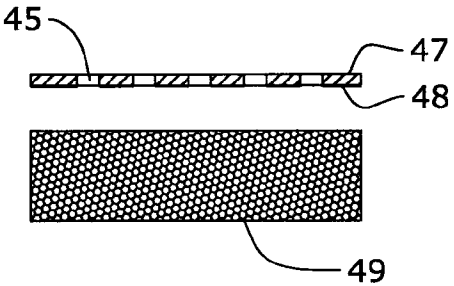
FIG. 2B is a cross-sectional view of a fiberboard sheet before attachment to a sheet of reticulated foam to form a composite sheet.
Figure 2A:
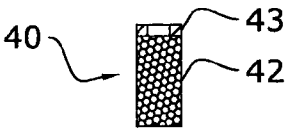
FIG. 2A is a cross-sectional view of one embodiment of a modified reticulated foam plug.

When the reticulated material is a relatively soft (low modulus) material, such as the above mentioned polyurethane open-celled foam, it is preferred that a modified reticulated plug is used in the instant connectors to aid in holding the foam in place while injecting fluid. One embodiment of a modified reticulated foam plug 40, shown in cross-section in FIG. 2A, comprises a circular cylindrical reticulated foam plug 42 and a coaxially oriented washer 43 affixed (cemented or adhered) to at least one end thereof. Preferably, the washer is affixed to only one end of the reticulated foam plug. The washer 43 can be fabricated from a stiff insulative material, such as epoxy, vulcanized fiber, fiberglass, a phenolic resin, ceramic, an engineering plastic, or the like, or it may be metallic. Again, both reticulated foam plug 42 and washer 43 have a diameter slightly greater than that of the injection port 58 to provide a snug fit therein. FIGS. 2B-2D show a sequence of steps for fabricating the modified reticulated plug 40. In FIG. 2B, a sheet of fiberboard 47 (e.g., $1/16^{th}$ inch thick, McMaster-Carr®p/n 8652K73) is perforated with a plurality of holes 45, then coated on one side with, e.g., J-B® Industro-Weld™ epoxy 48. The epoxy-coated side of fiberboard 47 is pressed against a similarly sized sheet of reticulated foam 49, previously described, and the epoxy allowed to cure. Once the bond is made, the fiberboard/foam composite is inserted into a punch 75 and die 76 assembly (FIG. 2C). There is a cylindrical protrusion 77 coaxially located on the leading face of the punch 75 that engages the hole 45 in the fiberboard (FIG. 2D) and the punch is driven through the die 76 to cut a cylinder out of the fiberboard/foam composite to form the modified reticulated plug 40 shown in FIG. 2A.

Figures 4A, 4B, 4C, 4D, 4E, 4F:
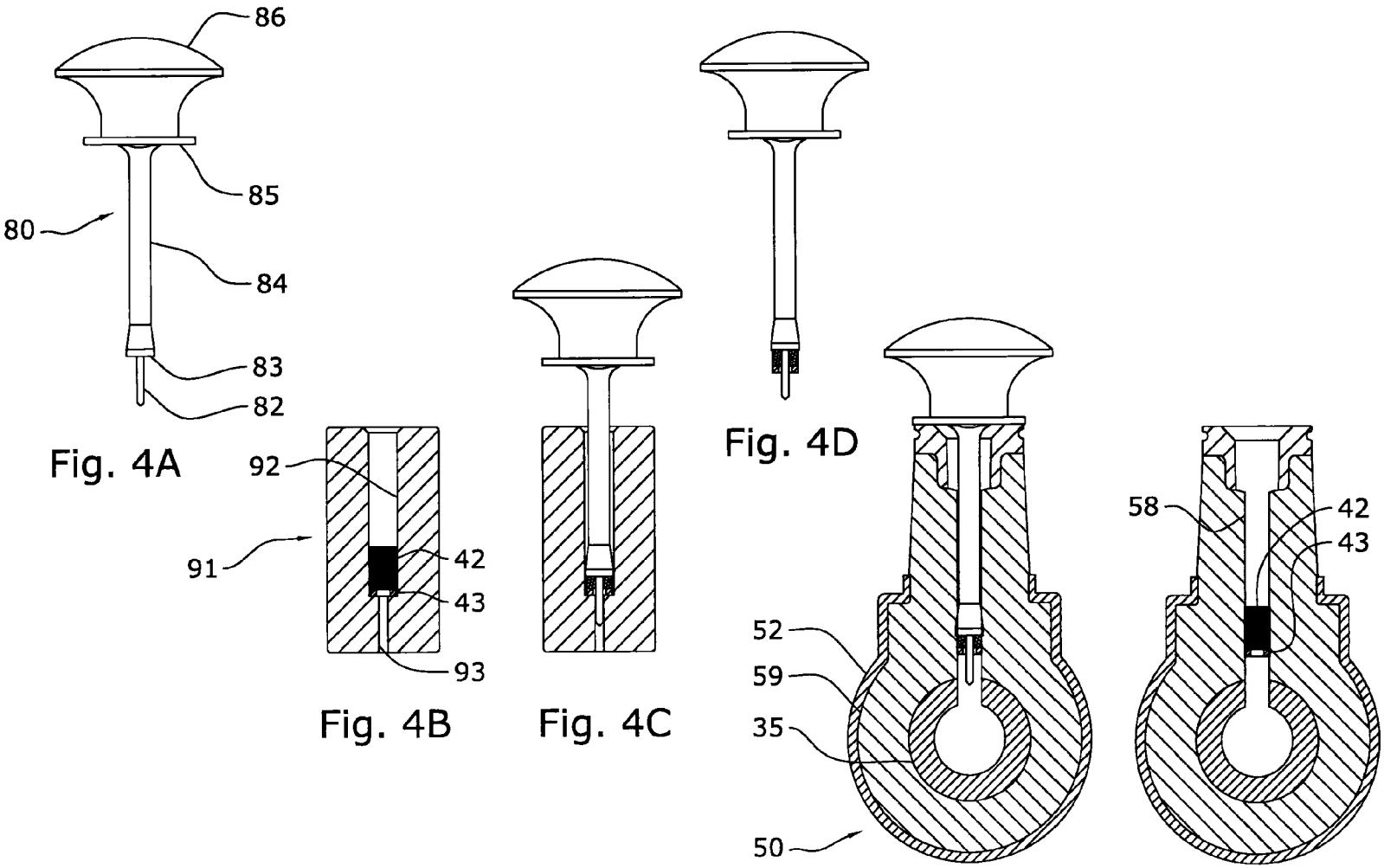
FIG. 4A is a plan view of an insertion tool used to introduce the modified reticulated plug shown in FIG. 2A into the injection port of an injection connector.
FIG. 4B is a cross-sectional view of a holder containing the modified reticulated foam plug of FIG. 2A
FIG. 4C is a partial cross-sectional view of the holder of FIG. 4B showing the insertion tool of FIG. 4A compressing the modified reticulated foam plug of FIG. 2A.
FIG. 4D is a partial cross-sectional view of the modified reticulated foam plug of FIG. 2A mounted on the insertion tool of FIG. 4A.
FIG. 4E is a partial cross-sectional axial view of an injection connector showing insertion of the modified reticulated foam plug of FIG. 2A into the injection port.
FIG. 4F is a cross-sectional axial view of the connector shown in FIG. 4E after the insertion tool is withdrawn.

The above described modified reticulated plug 40 can be inserted into the injection port 58 of the conventional connector 50, such as the elbow electrical connector shown in FIG. 1A, using a specialized insertion tool 80, illustrated in FIG. 4A. In a preferred procedure, the modified reticulated plug 40 is first inserted into a holder 91 having a larger partial bore 92 and a smaller partial bore 93, as shown in FIG. 4B. The insertion tool 80, which comprises a knob 86 at one end, a shaft 84 having a face 83 of slightly smaller diameter than partial bore 92, and a needle tip 82 at the other end, is then used to compress foam plug 42 within the holder 91. During this step, needle 82 pierces the foam plug 42 and passes through the inner diameter of the washer 43 as it enters the partial bore 93 (FIG. 4C). Friction of the foam plug 42 stretched around the needle 82 holds the foam plug against the face 83 of the insertion tool 80 (FIG. 4D). After the modified reticulated plug 40 is thusly mounted on the insertion tool, hand pressure is applied on knob 86 to push the tool and the plug down the bore of the injection port 58, washer end first until flange 85 of the tool seats against the mouth of the injection port (FIG. 4E). The depth of insertion of the modified reticulated plug 40 is controlled by the length of the shaft 84 extending beyond the stop flange 85 of the insertion tool 80 (FIG. 4E). When the insertion tool is withdrawn, friction between the foam plug 42 and the needle 82 causes the former to be dragged by the needle, and thereby recover at least some of its pre-compressed length (FIG. 4F). Upon extraction of the needle, the hole it made in the foam will tend to self close. In a variation of this embodiment, the washer can be star-shaped such that only its points contact the wall of injection port 58, and thus provide a suitable fluid path therebetween. Further, if the washer material is a metal, the insertion tool length is adjusted to locate the washer within the conductive insert 35 of the connector 50 during injection.

Figure 5D:
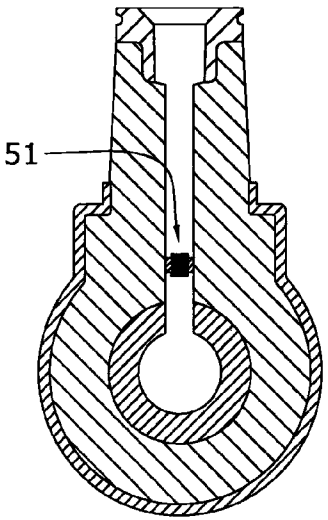
FIG. 5D shows the connector of FIG. 5C after the insertion tool is withdrawn.
Figure 5C:
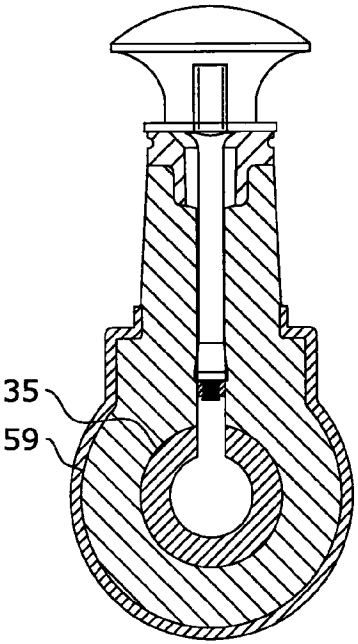
FIG. 5C shows the connector of FIG. 5B after the insertion tool shown in FIG. 5A is used to properly position the modified reticulated plug of FIG. 3F within the injection port.
Figure 5B:
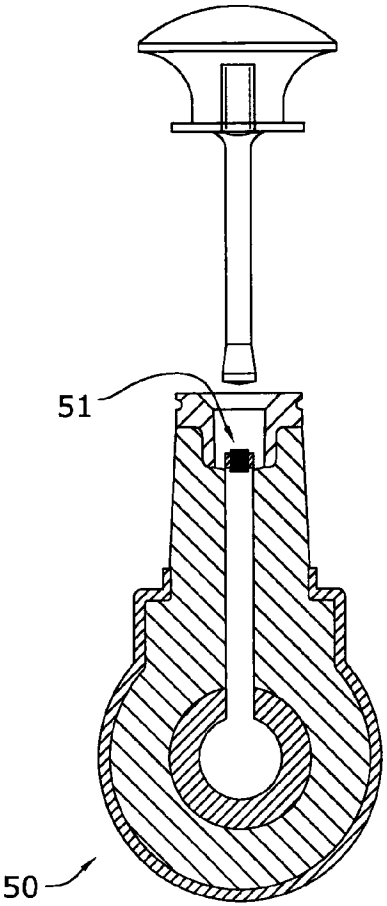
FIG. 5B is a partial cross-sectional axial view of an injection connector showing the modified reticulated foam plug of FIG. 3F positioned at the top of the injection port.
Figure 5A:
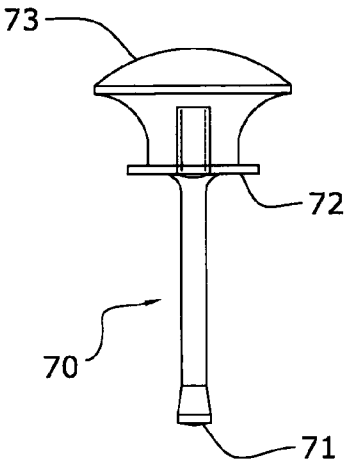
FIG. 5A is a plan view of an insertion tool used to introduce the modified reticulated plug shown in FIG. 3F into the injection port of an injection connector.

In another embodiment of a modified reticulated foam plug, the above described reticulated foam plug 42 is inserted into a relatively rigid (high modulus) insulative tube or jacket having an inner diameter and length slightly less than, or equal to, the corresponding values for the reticulated material, as shown in FIGS. 3B-3E, and discussed further below in the Examples section. It is further preferred that the reticulated material is affixed within this tube using, e.g., adhesive or cement, again as discussed below with reference to FIG. 3. The tube can be fabricated from a stiff material having high dielectric strength and resistivity, such as epoxy, fiberglass, phenolic resin, ceramic, an engineering plastic, or the like. This tube or jacket should have an outer diameter slightly greater than that of the injection port. This assures good purchase with the inner wall of the injection port when the thus modified reticulated plug is pushed into the port, thereby elastically stretching the adjacent elastomer (e.g., insulative projection 62 in FIGS. 1A and 1B). Additional purchase between such a modified reticulated plug and the injection wall of the injection port 58 of the connector 50, needed to resist the pressure differential due to the injected fluid, is possible when the outer surface of the tube further comprises circumferential ridges, protrusions, or spurs at one or more position along its length. This embodiment of the modified reticulated plug 51 (shown in FIG. 3F) can likewise be inserted into the injection port of a conventional injection elbow connector 50 using an insertion tool 70 (shown in FIG. 5A) having a slightly conical face 71, this geometry facilitating centering the face on a tube 44 (shown in FIG. 3B) of the modified reticulated plug. FIG. 5B shows the modified reticulated plug 51 positioned at the opening of the injection port 58. The face 71 of the tool 70 is brought into contact with the plug and pressed in until a flange 72 of the tool seats against the mouth of the injection port (FIG. 5C).

Figure 1E:
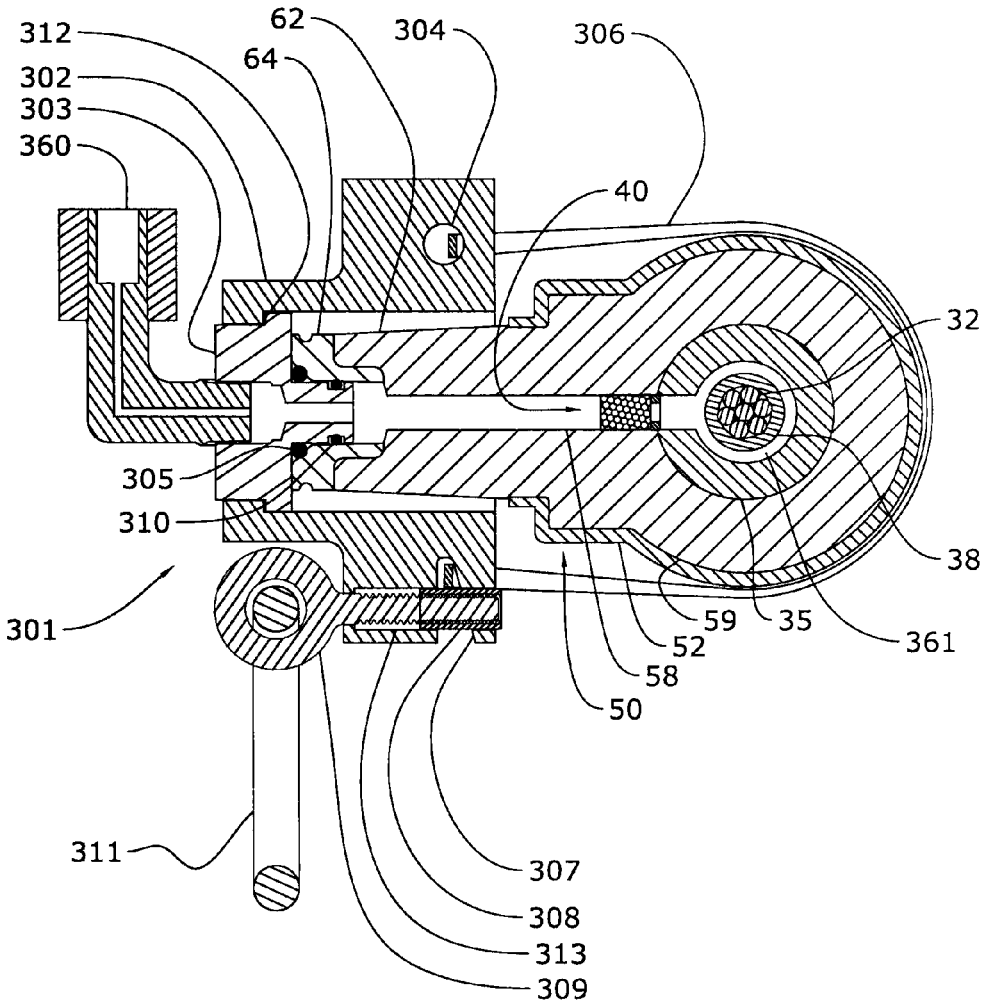
FIG. 1E is a cross-sectional axial view of an improved injection plug shown seated on a conventional injection elbow connector (in axial view) containing a modified reticulated plug.

Referring now to FIG. 1B, according to one embodiment of the instant connector, a reticulated plug (e.g., a modified reticulated plug 51 or a modified reticulated plug 40, such as described above comprising the foam plug 42 and the washer 43) is positioned within the injection port 58, preferably proximal to the conductive insert 35, so as to fill at least a portion of the insulated segment of the injection port 58. Thus, it should be apparent to those skilled in the art that, in order to effectively inhibit flashover while injecting an energized cable and/or swapping a permanent plug 61 for an injection plug (such as the typical injection plug 56 of FIG. 1C or an improved injection plug 301 described below and illustrated in FIG. 1E), at least a part of the instant reticulated plug should reside within an insulated segment of the injection port 58, and thus block this part of the port. In other words, although some part of the reticulated plug can extend into the conductive insert 35, at least a part thereof, and preferably the entire reticulated plug, is positioned outside of this region (e.g., above insert 35, as illustrated in FIG. 1B). However, it is preferred that any conductive portion of the modified reticulated plug, if present, is positioned within the conductive insert. Thus, for example, in using a conventional injection plug of the type illustrated in FIG. 1C, the length of an injection tube 55 thereof should be adjusted to be consistent with the above described positioning of the reticulated plug. Referring now to FIG. 1E, the connector 50 is shown using an improved injection plug 301 for injection of a dielectric enhancement fluid. Two O-rings 305 and 310 make a fluid-tight seal between the injection plug 301 and a nose piece 64 of the injection port 58 of the connector 50 and allow fluidic communication between a tube connection 360 and an internal chamber within which the compression connector 38 is located and which has an annular volume 361 between compression connector 38 and the conductive insert 35, the fluid passing through the modified reticulated plug 40 to reach the annular volume. The annular volume 361 provides a flow path to the conductor strands 32 of the cable shown in FIGS. 1A and 1B.

During the introduction of fluid to a cable within connector 50, as shown in FIG. 1E, the injection plug 301 is held against the insulative projection 62 by adjustable straps 306 that can be cinched tight. This preferred injection plug 301 uses two Thomas & Betts General Purpose Ties, Cat. No. L-11-40-9-C, formed into loops. One end of each strap 306 is retained in a hole 304 in a dust cover 302 positioned at the nose piece 64 of the injection port 58 and the other end thereof is retained in an area located on the opposite side to the connector 50 at the top of a ramp 307 by a sleeve 308. The dust cover 302, made of nylon or similar material, has an inner rim that engages a shoulder 312 of a port block 303 to transfer the pulling force created by the adjustable straps 306 to the port block, thereby pressing a face of the port block against the projection 62. The port block 303, also made of nylon or similar material, supports the tube connection 360, retains the two O-rings 305 and 310 with respect to the nosepiece 64 to make a fluid-tight seal, and has a passage for conducting fluid into the injection port 58.

If a live injection is being carried out, the injection plug 301 can be released from the connector 50 by means of a hot stick engaging a pull ring 311 passing through the eye of an eye bolt 309 and moving the pull ring away from the body of the connector 50. As the eye bolt 309 is moved outward by the pull ring 311, it draws the sleeve 308 longitudinally outward along a bore 313 until the end of the sleeve clears the ramp 307 to create an escape passageway between the end of the sleeve and the ramp, thereby allowing the end of the adjustable strap 306 retained at the ramp 307 to slide off the ramp and fall away, thereby releasing the injection plug 301 from the connector.

According the instant method, the following steps are carried out in the injection of a dielectric enhancement fluid into the interior of an electrical cable having an inlet end and an outlet end. Although described for the case of an injection elbow connector 50, it is contemplated that the general method applies equally to other injection components, such as an injection splice connector.

Preparation Steps

1. If the cable does not already have an injection connector attached at each end thereof, de-energize the cable and replace each existing connector with an injection connector having a reticulated plug within its injection port, as described above.

2. If the cable is already fitted with a conventional injection connector at each end thereof, de-energize the cable and insert a reticulated plug into the injection port of each connector, as described above. Preferably, wet the reticulated plug with the dielectric enhancement fluid to be used (e.g., 0.5 to 1 ml). It is believed that the fluid fills, or partially fills, many of the air and water vapor filled voids of the reticulated plug and thus improves the dielectric properties thereof as air and water vapor are more easily ionized than a dielectric fluid. Air and water vapor facilitate the undesired flashover. At this point, the cable can be re-energized, but it is preferred that this be done after step 3, below. Alternatively, it is also possible to carry out the insertion of the reticulated plug while the cable is still energized using appropriate hot-stick techniques.

3. Install an injection plug, such as that shown in FIG. 1C or, preferably, that shown in FIG. 1E, at the injection port of each connector. This step is preferably performed on a de-energized cable, but could be carried out while the cable is still energized using appropriate hot-stick techniques.

Injection Steps (the Following Steps are Generally Carried Out while Cable is Energized, but May Also be Performed on De-Energized Cables.)

4. Inject the dielectric enhancement fluid at the inlet end connector using a pressure compatible with the component(s) and cable until the fluid starts to exit the outlet end.

5. Swap the injection plug with a permanent plug, such as shown in FIG. 1D, at the outlet end, thereby sealing the injection connector at the outlet end. The permanent plug should have an inserted length at least sufficient to fill the entirety of the injection port volume at least to the interface between the insulation of projection 62 and conductive insert 35. Preferably, the permanent plug has a length sufficient such that, when seated in place, its tip is within the outer boundary of the conductive insert of the connector, thereby compressing one of the above described reticulated foam plugs and/or pushing the latter into the conductive insert and/or into the annular space between the conductive insert and the conductor/crimp connector.

6. Discontinue fluid injection and swap a permanent plug for the injection plug at the inlet end, thereby sealing the injection connector at the inlet end, in the same manner as described in above step 5. Optionally, a "soak period" of several days to several months is contemplated between steps 5 and 6 while the cable is typically energized, wherein the fluid flow into the cable continues as the fluid within the cable diffuses through the insulation jacket thereof, as is well known in the art.

Thus, there is also disclosed an improved method for introducing a dielectric enhancement fluid into the interior of a cable affixed in an internal chamber of a connector having an injection port in fluidic communication with the chamber, the method comprising:

(i) inserting a reticulated plug into an insulated segment of the injection port so as to fill at least a portion thereof;

(ii) installing an injection plug at the injection port;

(iii) injecting the fluid into the interior of the cable through the injection plug; and (iv) swapping the injection plug with a permanent plug to seal the injection port, wherein the cable is energized during at least step (iv), and thereby suppressing flashover between the energized conductor (or conductive insert) and a ground plane.

EXAMPLES

Figure 3A:
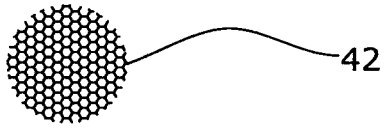
FIG. 3A is a cross-sectional axial view of a reticulated foam plug.
Figure 3B:
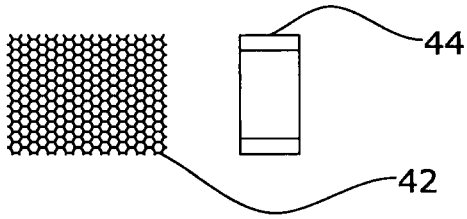
FIG. 3B is a cross-sectional view of the reticulated foam plug of FIG. 3A and a fiberglass tube.
Figure 3C:
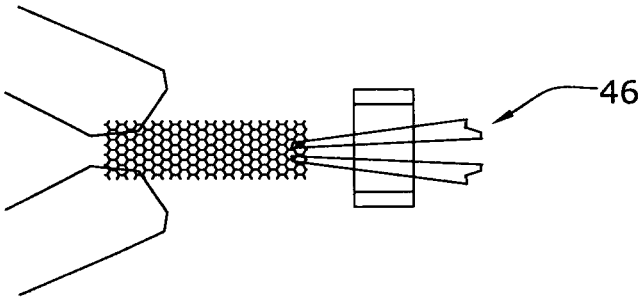
FIG. 3C shows the reticulated foam plug of FIG. 3A being drawn into the fiberglass tube using tweezers.
Figure 3D:
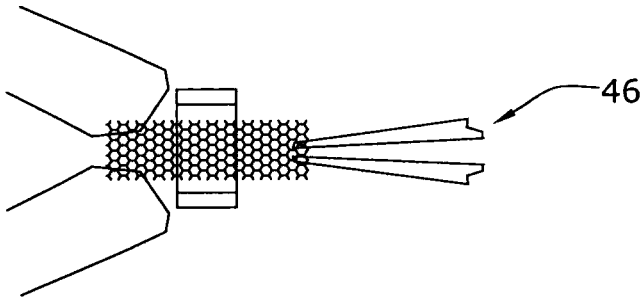
FIG. 3D shows the reticulated foam plug of FIG. 3A centrally positioned within the fiberglass tube.
Figure 3E:
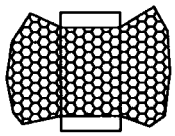
FIG. 3E shows the reticulated foam plug of FIG. 3A within the fiberglass tube after being cemented therein.
Figure 3F:
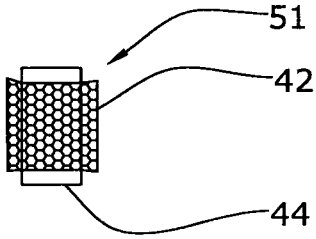
FIG. 3F shows a second embodiment of a modified reticulated foam plug obtained after the foam ends shown in FIG. 3E were trimmed.

Several modified reticulated plugs used in subsequent testing were prepared as follows. With reference to FIG. 3A, foam plug 42 having an approximate diameter of ¼ inch and a height of about ⅓ inch was cut out of a reticulated open cell polyurethane foam sheet (McMaster-Carr® part number 8643K601, Polyurethane Foam Sheet, 1" Thick, 12"×12", Firmness Rating 1). The inside surface of a fiberglass tube 44, FIG. 3B, was coated with an epoxy adhesive (J-B Weld® Industrial Cold Weld Compound, No. 8280, McMaster-Carr® 7605A12) and one end of foam plug 42 was then pulled through the interior of tube 44 using tweezers 46, as shown in FIGS. 3C and 3D. The foam was first stretched to reduce its diameter, then allowed to recover when foam plug 42 was centered within the tube 44, as shown in FIG. 3E. The assembly was allowed to stand for several hours to allow the adhesive to harden. Finally, the ends of foam plug 42 were trimmed such that no more than about 1/16 inch thereof protruded from either end of the tube 44 to produce the modified reticulated plug 51 shown in FIG. 3F.

Six injection elbow connectors (Elastimold® 168 DELR-7495) of the type shown in FIG. 1 were installed on ends of six 7-foot lengths of I/O strand-blocked cable. The other ends of the cables were terminated with high voltage laboratory water terminals prior to the application of voltage. A permanent cap 61 (see FIG. 1D) was inserted and seated in the injection port 58 of each of the above elbow connectors. As per IEEE® 386 7.4, voltage applied to each cable was raised to 20% above the partial discharge (PD) minimum extinction voltage specified in IEEE 386 Table 1. This is 13.2 kV rms for the 8.3/14.3 kV rated elbow connectors used in this example. If the PD peak value had exceeded 3 picocoulombs (pC) the test voltage would have been lowered to 11 kV and maintained at this level for 3 to 60 seconds. All elbow connectors experienced less than 3 pC of PD and met the IEEE 386 requirement.

Each of the elbow connectors was secured such that its injection port faced directly upward, the permanent cap was removed and the injection port left open, whereupon 2.5 ml of Ultrinium™ 732 g/40 dielectric enhancement fluid formulation (see table below) was introduced into the annular region of the internal chamber, between the semi-conducting insert 35 and the conductor 32/compression connector 38 (see FIG. 1), using a syringe, being careful not to let any fluid contaminate the interior of the injection port.

| Component | CAS #(s) | Ultrinium ™ 732 g/40 (w %) |
|---|---|---|
| Tolylethylmethyldimethoxysilane | 722542-80-5 | 19.3% |
| dimethoxymethyl[2-(methyl-phenyl)ethyl]silane | 722542-79-2 | 23.7% |
| Cyanobutylmethyldimethoxysilane | 793681-94-4 | 37.3% |
| Ferrocene | 102-54-5 | 2% |
| isolauryl alcohol | 3913-02-8 | 8.6% |
| Tinuvin ® 123 | 129757-67-1 | 2.6% |
| Tinuvin ® 1130 | 104810-48-2 | 1.6% |
| Geranylacetone | 3796-70-1 | 1.6% |
| 4,6-bis (octylthiomethyl)-o-cresol | 110553-27-0 | 3.2% |
| dodecylbenzenesulfonic acid | 68584-22-5 | 0.0645% |
| total | | 100% |

This was followed by the introduction of 2.5 ml of tap water into the above mentioned annular region of each elbow connector, again using a syringe and being careful not to let any water contaminate the interior of the injection port. These injections of dielectric enhancement fluid and water filled the annular region between conductive insert and conductor/crimp connector as well as a portion of the injection port at the conductive insert, but not the insulated portion of the port. The water-fluid mixture simulates field conditions of a contaminated fluid injection.

Each elbow connector was randomly assigned a number from 1 to 6, the odd numbered elbow connectors serving as controls having open injection ports and the even numbered elbow connectors being fitted with a modified reticulated plug, as follows. A modified reticulated plug, as prepared above, was inserted into the entrance of the injection port of each even numbered elbow connector such that its longitudinal axis was coincident with that of the port. Tip 71 of the insertion tool 70 shown in FIG. 5A was centered on each modified reticulated plug 51 and handle 73 was gently pushed to drive it along a portion of the length of the injection port toward the conductor. Shoulder 72 of tool 70 acted as a stop against the top surface of the injection port, which assured that the modified reticulated plug did not extend into the conductive insert (35 of FIGS. 5B-5D). At this point, 0.2 ml of the above described dielectric enhancement fluid was introduced at the opening of the injection port to wet the reticulated material.

Each cable length was energized and the voltage increased 1 kV per minute until a flashover to ground occurred. The table below reports observed flashover voltages for the six elbow connectors. It can be seen that the use of the instant modified reticulated plug provided an approximately 39% increase in mean flashover voltage over the control having an open injection port.

| | Flashover (kV) | |
|---|---|---|
| | With reticulated plug | Without reticulated plug |
| | 51 | 40 |
| | 53 | 39 |
| | 46 | 29 |
| Mean (kV) | 50 | 36 |
| Standard deviation (kV) | 3.6 | 6.1 |

We claim:

1. A cable connector configured for introducing a fluid to an electrical cable therein, the connector comprising:

a connector body with an interior chamber sized for receiving and retaining therein a portion of the electrical cable, the connector body having an insulated portion;

a fluid injection port comprising a fluid conduit extending between an exterior portion of the connector body and the interior chamber with at least a portion of the conduit passing through the insulated portion of the connector body, the conduit being configured for the flow of the fluid between the exterior of the connector body and the internal chamber; and a plug positioned within the portion of the conduit passing through the insulated portion of the connector body, the plug being porous and sized to fit within the conduit and to at least partially obstruct the conduit and increase the electrical resistance of the fluid path within the conduit extending between the exterior portion of the connector body and the interior chamber when the portion of the cable within the interior chamber is energized.

2. The connector of claim 1, wherein said connector is an injection elbow.

3. The connector of claim 1, wherein said plug is formed from a reticulated open-celled foam.

4. The connector of claim 3, wherein said open-celled foam is a polyurethane.

5. The connector of claim 1, wherein said plug is formed from a material selected from organic sponge, synthetic sponge, cotton, woven textile, non-woven textile, plastic open-celled foam, elastomeric open-celled foam, felt, fiberglass, sintered glass, or sintered ceramic.

6. The connector of claim 1, wherein said plug is a reticulated open-celled foam circular cylinder having a washer coaxially affixed to one end thereof.

7. The connector of claim 1, wherein said plug is a reticulated open-celled foam circular cylinder inserted into an insulative tube sized to fit within the conduit.

8. The connector of claim 7, wherein said insulative tube is fabricated from a material selected from epoxy, fiberglass, phenolic resin, ceramic, or an engineering plastic.

9. A high voltage electrical connector comprising:

(a) an insulative body portion;

(b) a conductive body portion external shield at least partially surrounding the insulative body portion;

(c) a projection of electrically insulating material having a first end connected to the insulative body portion and a second end extending from the insulative body portion;

(d) an injection port extending through the projection and having an opening in the second end of the projection in communication with an exterior of the electrical connector, the injection port communicating between the opening and a conductive insert of an interior of the electrical connector, the injection port having an insulated segment; and (e) a reticulated plug positioned within the insulated segment of the injection port so as to fill at least a portion thereof and to at least partially obstruct the injection port and increase the electrical resistance of a fluid path within the injection port when a portion of an energized cable is positioned within the conductive insert.

10. The connector of claim 9, wherein said connector is an injection elbow.

11. The connector of claim 9, wherein said reticulated plug is formed from a reticulated open-celled foam.

12. The connector of claim 11, wherein said open-celled foam is a polyurethane.

13. The connector of claim 9, wherein said reticulated plug is formed from a material selected from organic sponge, synthetic sponge, cotton, woven textile, non-woven textile, plastic open-celled foam, elastomeric open-celled foam, felt, fiberglass, sintered glass, or sintered ceramic.

14. The connector of claim 9, wherein said reticulated plug is a reticulated open-celled foam circular cylinder having a washer coaxially affixed to one end thereof.

15. The connector of claim 9, wherein said reticulated plug is a reticulated open-celled foam circular cylinder inserted into an insulative tube.

16. The connector of claim 15, wherein said insulative tube is fabricated from a material selected from epoxy, fiberglass, phenolic resin, ceramic, or an engineering plastic.

17. In a cable connector for introducing fluid to a cable, the cable connector having an injection port exposed to at least one exterior surface of the cable connector and a chamber internal to the cable connector adapted for affixing a cable internal to the chamber, wherein the injection port has an insulated segment, and the injection port and the chamber are configured to provide fluidic communication therebetween, the improvement comprising:

a reticulated plug positioned within the insulated segment of the injection port and sized to fill at least a portion of thereof and to at least partially obstruct the injection port and increase the electrical resistance of a fluid path within the injection port extending between the chamber and the exterior surface of the cable connector when the cable in positioned within the chamber and energized.

18. The connector of claim 17, wherein said connector is an injection elbow.

19. The connector of claim 17, wherein said reticulated plug is formed from a reticulated open-celled foam.

20. The connector of claim 19, wherein said open-celled foam is a polyurethane.

21. The connector of claim 17, wherein said reticulated plug is a reticulated open-celled foam circular cylinder having a washer coaxially affixed to one end thereof.

22. The connector of claim 17, wherein said reticulated plug is a reticulated open-celled foam circular cylinder inserted into an insulative tube.

* * * * *